US009890495B2

(12) United States Patent
Lee et al.

(10) Patent No.: US 9,890,495 B2
(45) Date of Patent: Feb. 13, 2018

(54) LAUNDRY TREATING APPARATUS

(71) Applicant: LG ELECTRONICS INC., Seoul (KR)

(72) Inventors: Aram Lee, Seoul (KR); Jaeseok Kim, Seoul (KR); Incheol Kang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/117,951

(22) PCT Filed: Mar. 20, 2015

(86) PCT No.: PCT/KR2015/002773
§ 371 (c)(1),
(2) Date: Aug. 10, 2016

(87) PCT Pub. No.: WO2015/142124
PCT Pub. Date: Sep. 24, 2015

(65) Prior Publication Data

US 2016/0348298 A1 Dec. 1, 2016

(30) Foreign Application Priority Data

Mar. 21, 2014 (KR) ..... 10-2014-0033182

(51) Int. Cl.
*D06F 39/14* (2006.01)
*D06F 58/20* (2006.01)

(52) U.S. Cl.
CPC ..... *D06F 39/14* (2013.01); *D06F 58/20* (2013.01)

(58) Field of Classification Search
CPC ..... A47L 15/4246
(Continued)

(56) References Cited

U.S. PATENT DOCUMENTS 2,487,745 A * 11/1949 Witmer ..... E05B 83/36 16/292
3,538,641 A * 11/1970 Lux ..... D06F 37/28 16/232

(Continued)

FOREIGN PATENT DOCUMENTS

CN 1889815 1/2007
CN 103314151 9/2013

(Continued)

OTHER PUBLICATIONS

International Search Report and Written Opinion dated Jun. 4, 2015 issued in Application No. PCT/KR2015/002773 (full English text).

(Continued)

*Primary Examiner* — Matthew W Ing
(74) *Attorney, Agent, or Firm* — Ked & Associates, LLP

(57) ABSTRACT

A laundry treating apparatus comprising a cabinet including a laundry introduction port, a door to open and close the introduction port, a hinge unit configuring a first rotating axis and a second rotating axis, the hinge unit including a first shaft and a second shaft configuring the first rotating axis and a third shaft and a fourth shaft configuring the second rotating axis, and a rotating shaft shifting unit that rotatably fastens the door to any one of the first rotating axis and the second rotating axis, the rotating shaft shifting unit including a first shifting unit and a second shifting unit selectively and rotatably fastening the fourth shaft to the cabinet. The fourth shaft includes a protrusion protruding toward the second shifting unit, and a fourth side flat surface is formed on the protrusion and supports the second shifting unit by establishing surface contact with the second shifting unit.

14 Claims, 13 Drawing Sheets

(58) Field of Classification Search
USPC ..... 312/228, 319.1, 319.2, 326–329; 292/163, 175, 177; 126/194; 134/57 DL, 134/58 DL; 49/192
See application file for complete search history.

(56) References Cited

U.S. PATENT DOCUMENTS

| | | | | |
|---|---|---|---|---|
| 3,802,124 | A * | 4/1974 | Guerrini | E05D 15/526 49/192 |
| 3,909,877 | A * | 10/1975 | Christy | E05F 3/221 16/49 |
| 4,445,717 | A * | 5/1984 | Imhoff | E05B 17/0058 292/177 |
| 7,258,373 | B2 | 8/2007 | Plett et al. | |
| 7,669,908 | B2 | 3/2010 | Townson | |
| 2006/0123855 | A1* | 6/2006 | Erickson | D06F 37/28 68/24 |
| 2008/0109987 | A1* | 5/2008 | Chen | E05F 5/10 16/68 |
| 2008/0172838 | A1 | 7/2008 | Choi | |
| 2010/0295428 | A1* | 11/2010 | Favaro | D06F 39/14 312/228 |
| 2012/0161594 | A1* | 6/2012 | Kim | D06F 39/14 312/228 |
| 2012/0217851 | A1* | 8/2012 | Bae | D06F 39/14 312/222 |
| 2015/0233042 | A1 | 8/2015 | Kang et al. | |

FOREIGN PATENT DOCUMENTS

| | | |
|---|---|---|
| EP | 2 907 912 | 8/2015 |
| JP | H 08270308 | 10/1996 |
| KR | 10-0465690 | 1/2005 |

OTHER PUBLICATIONS

Chinese Office Action dated Apr. 28, 2017 issued in Application No. 201580012675.0 (English translation attached).
European Search Report dated Nov. 27, 2017 issued in Application No. 15764349.5.

* cited by examiner

[Fig. 1]
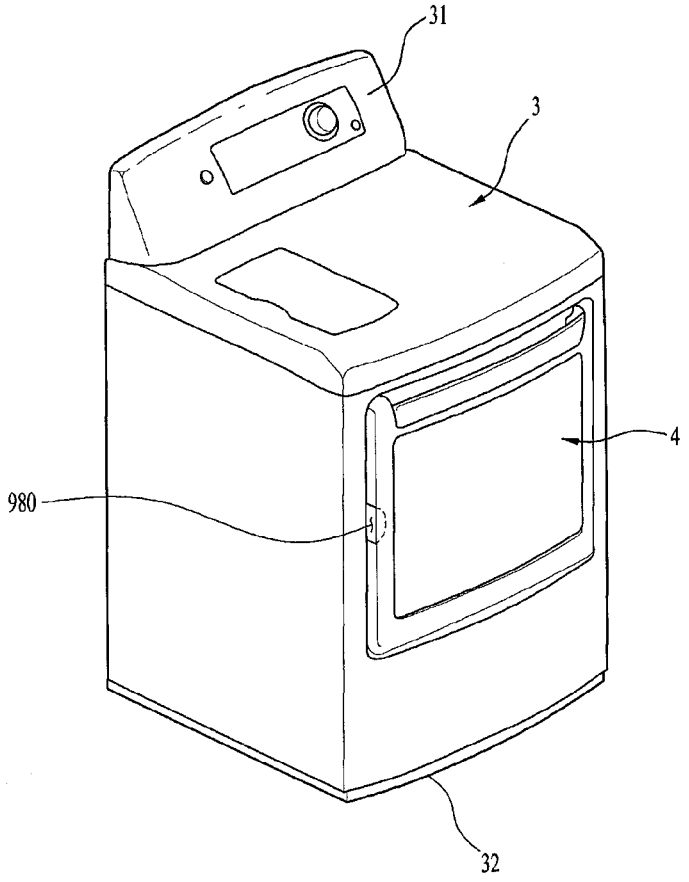

[Fig. 2]
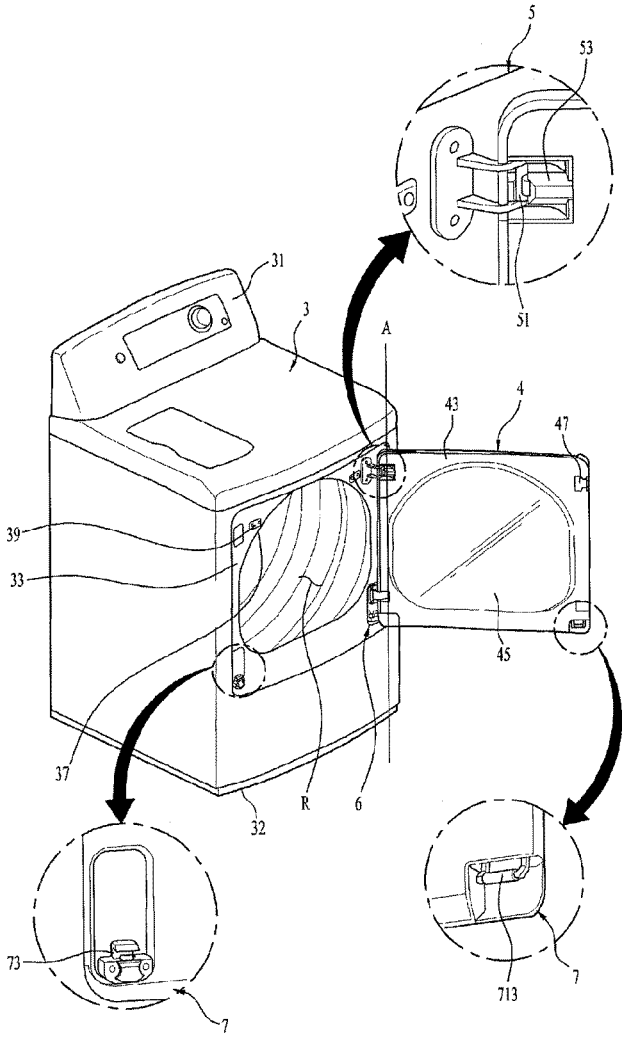

[Fig. 3]
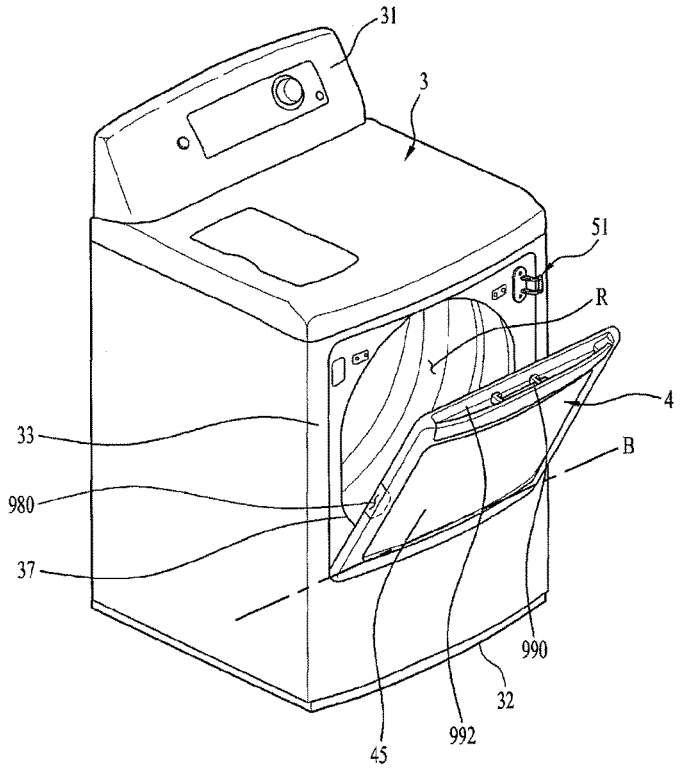
[Fig. 4]
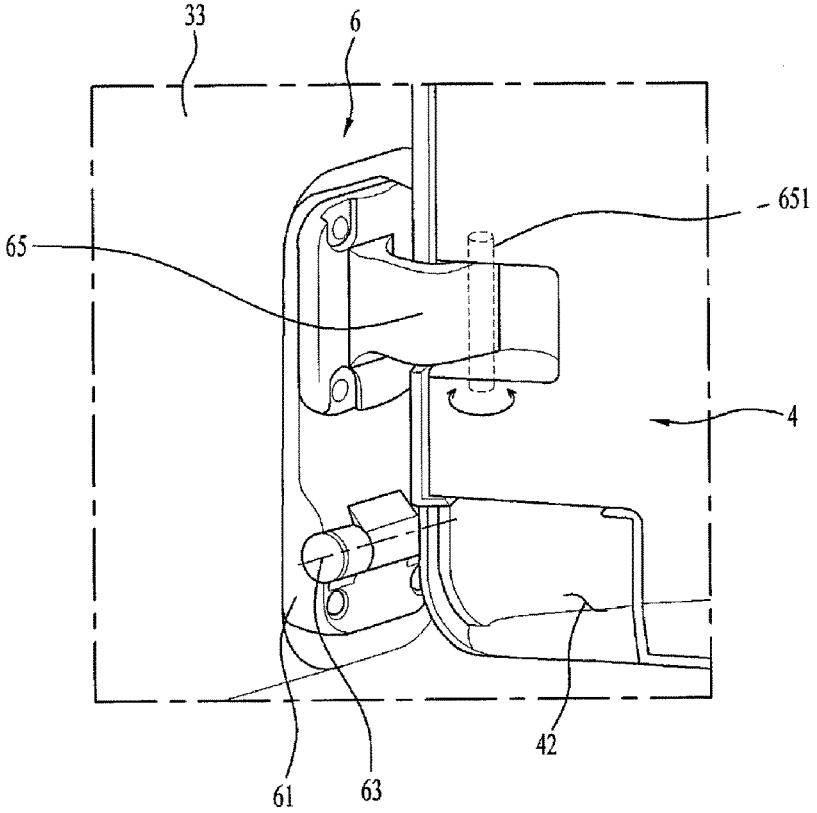

[Fig. 5]
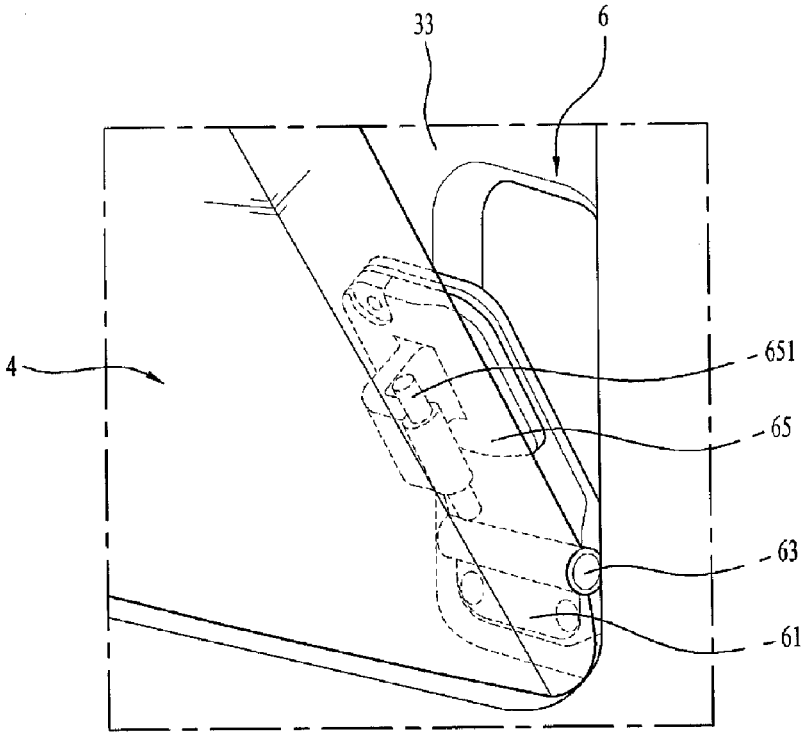
[Fig. 6]
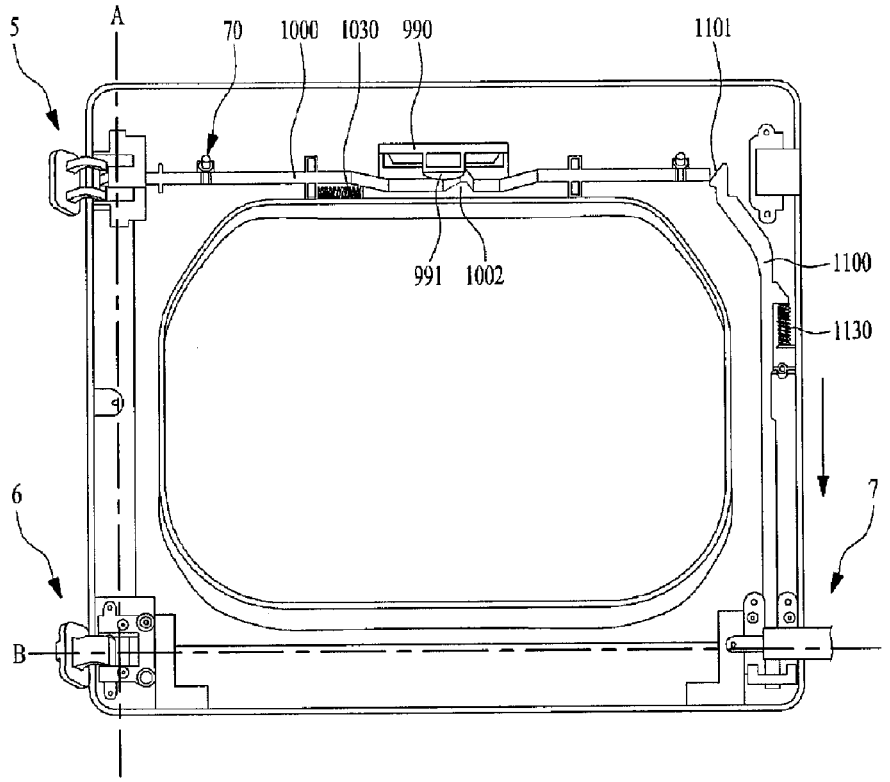

[Fig. 7]
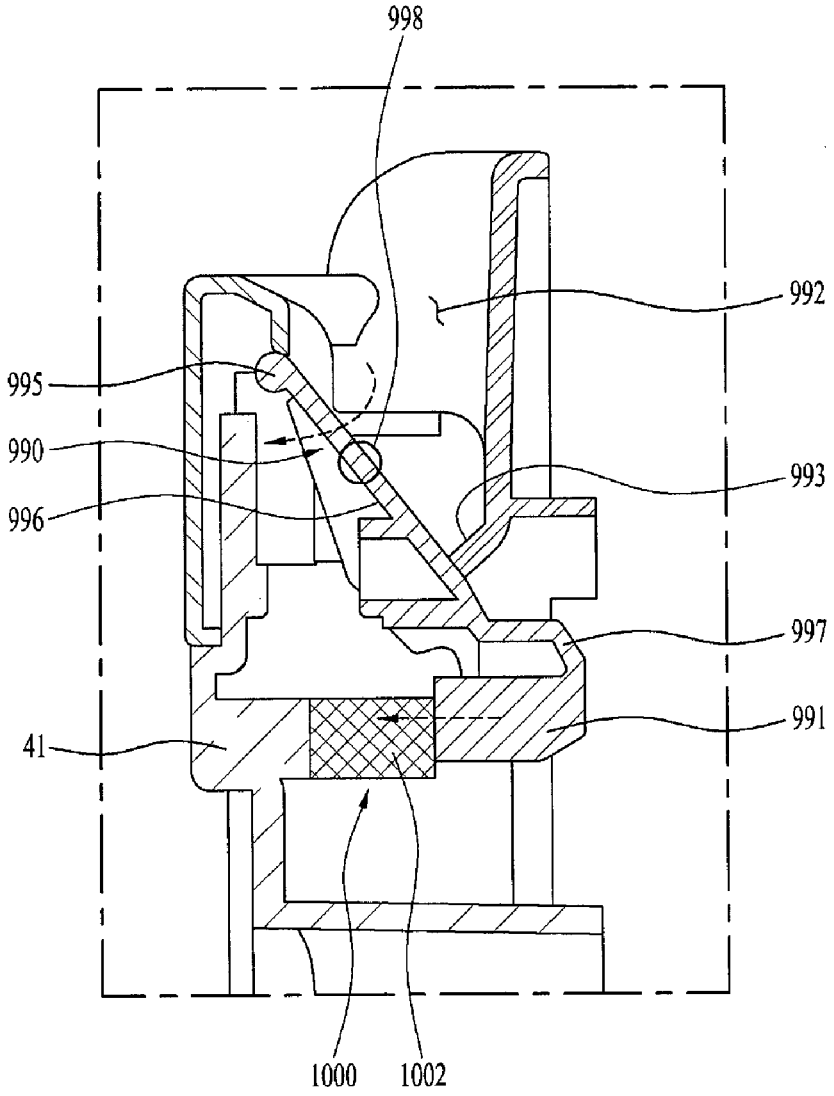

[Fig. 8]
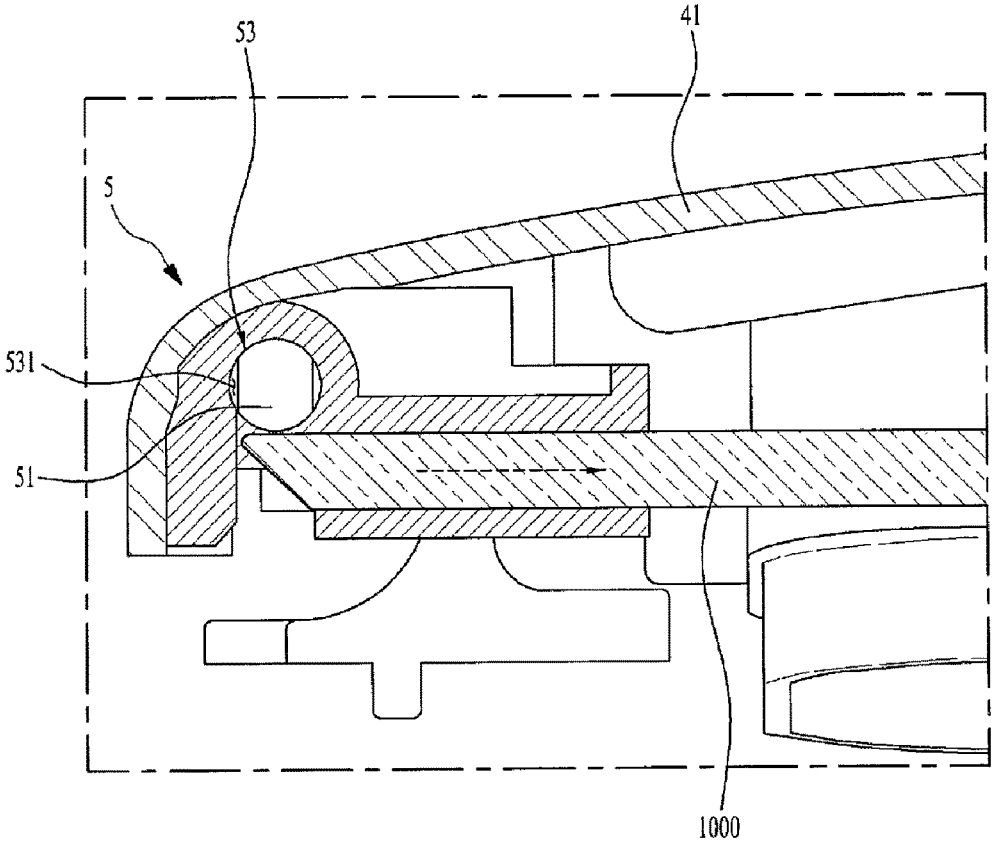

[Fig. 9]
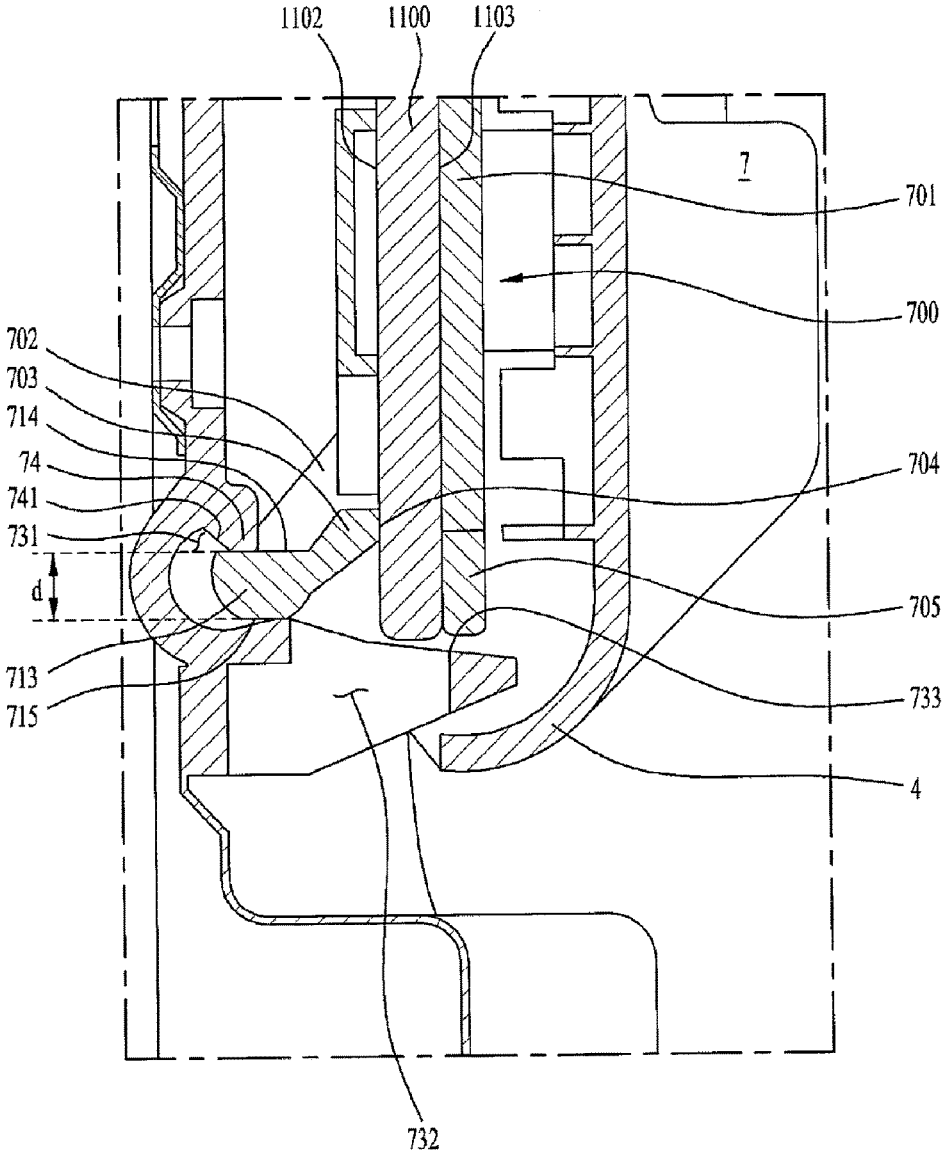

[Fig. 10]
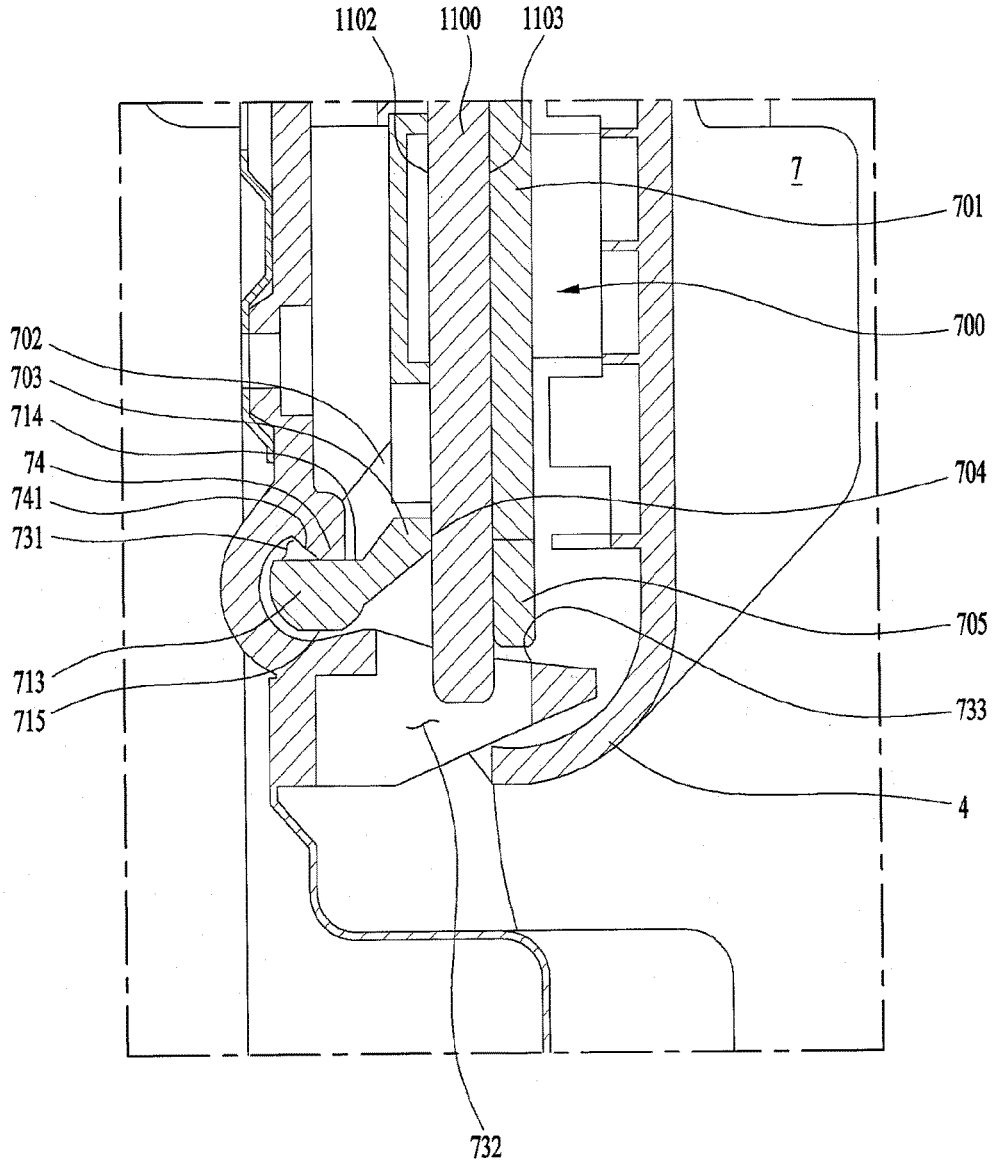

[Fig. 11]
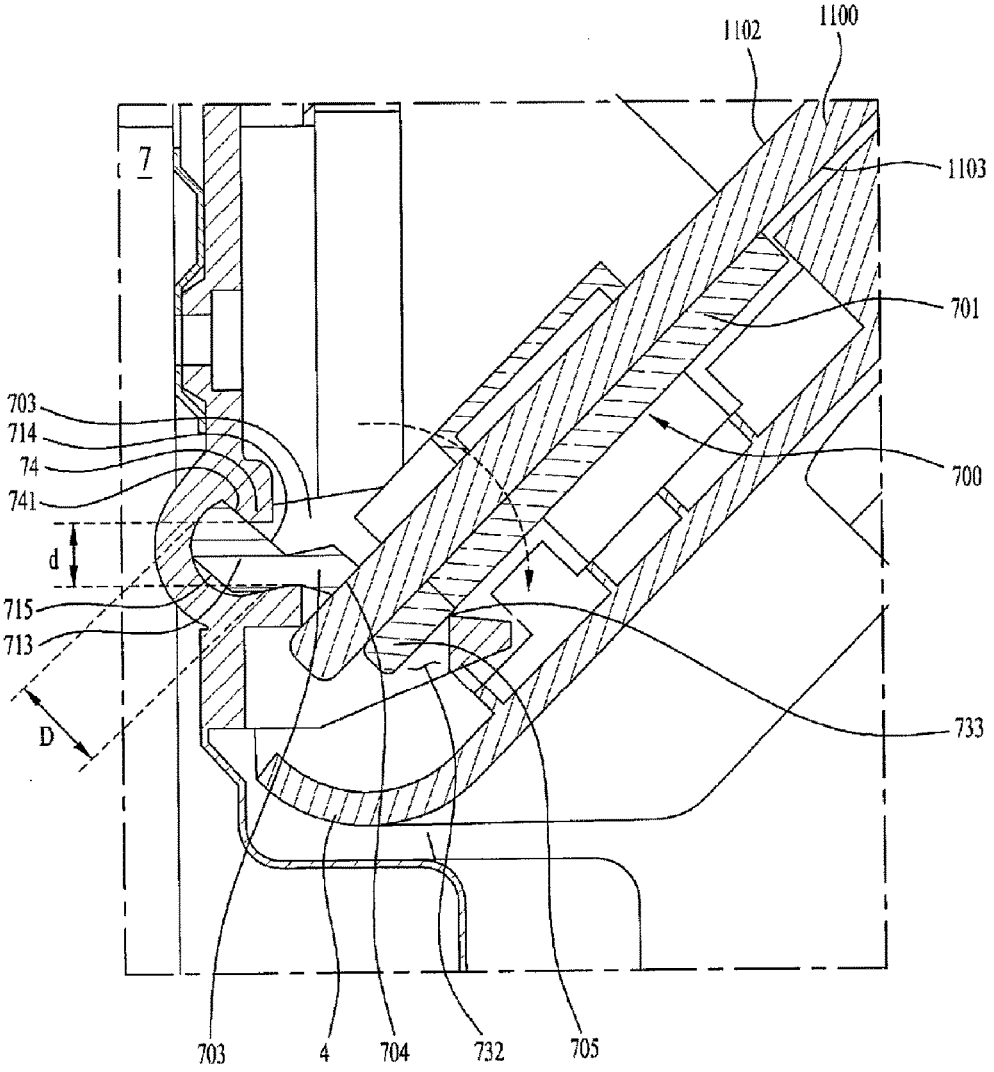

[Fig. 12]
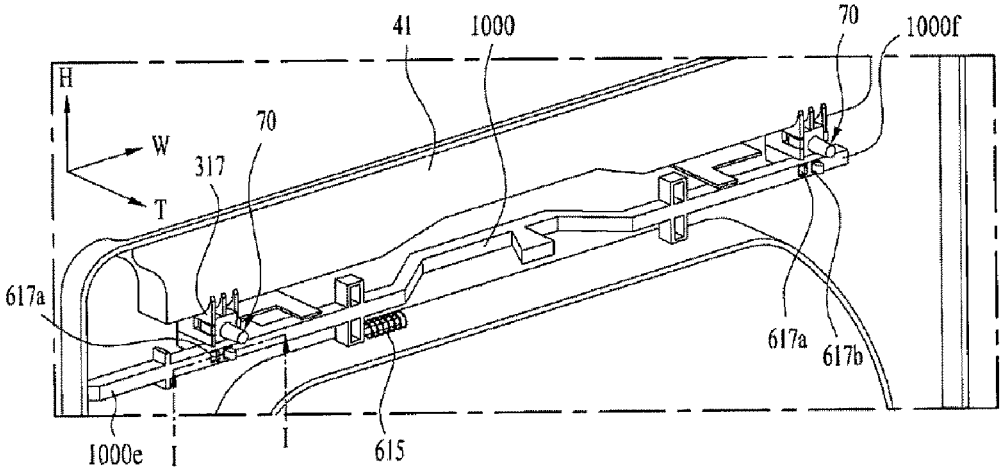
(a)
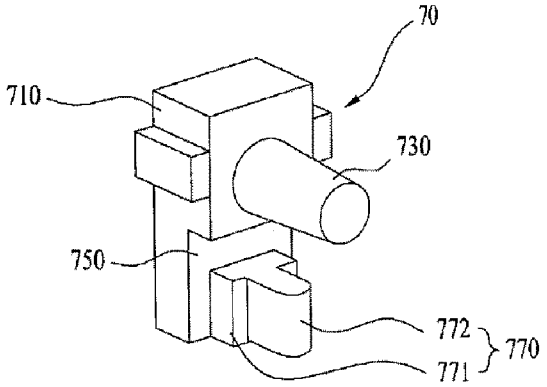
(b)

[Fig. 13]
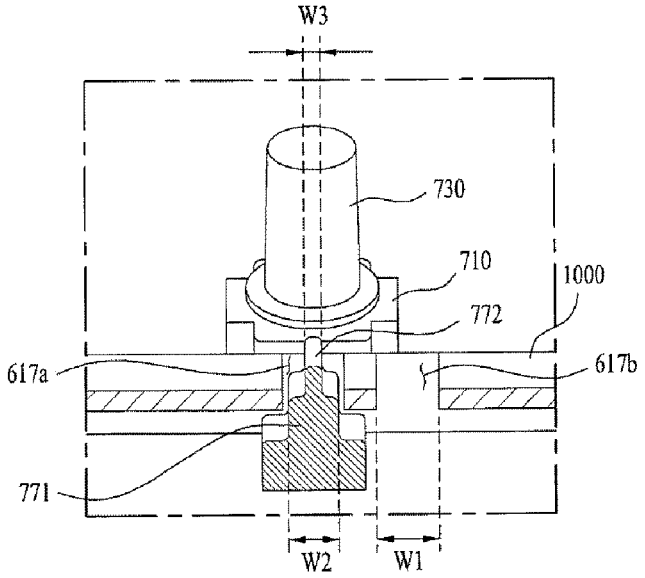
(a)
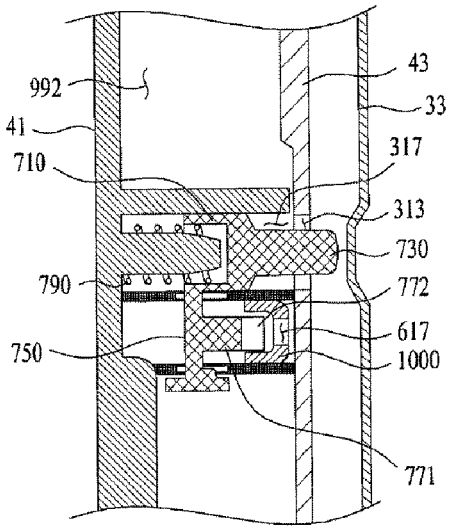
(b)

[Fig. 14]
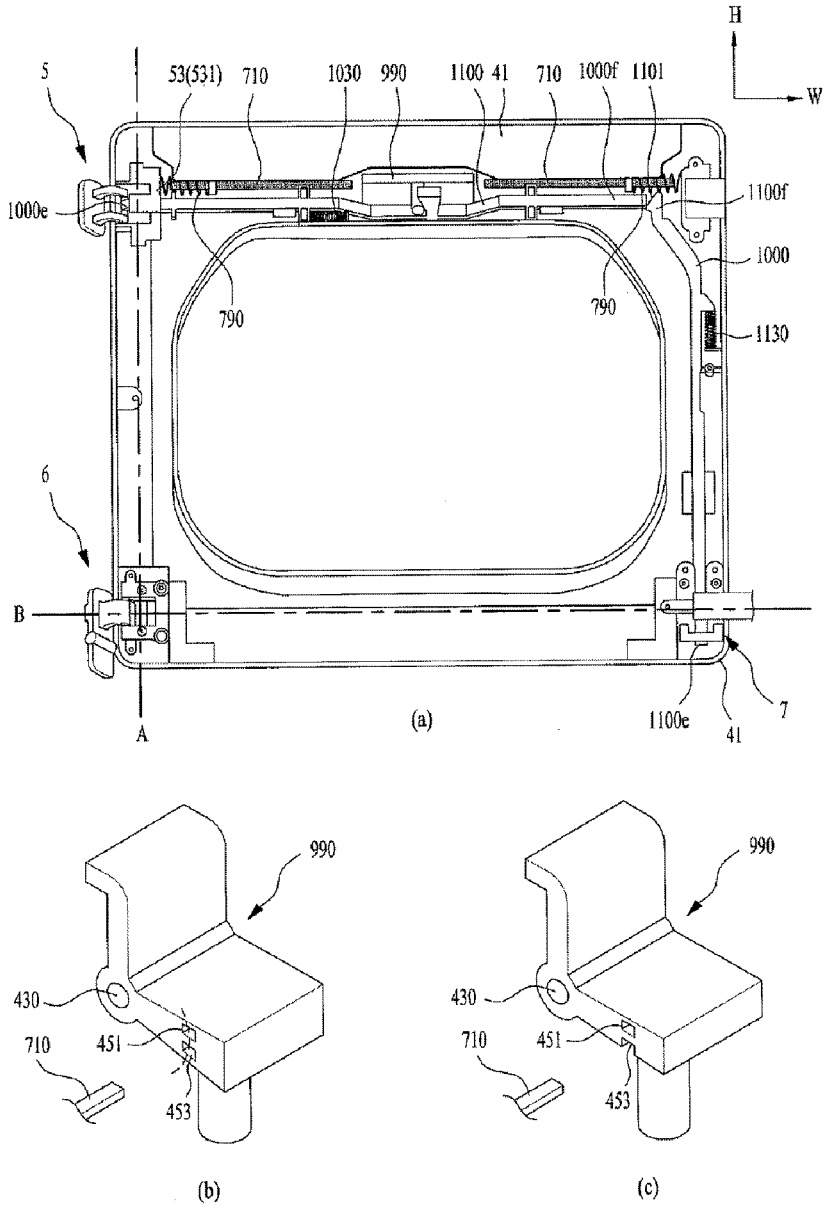

[Fig. 15]
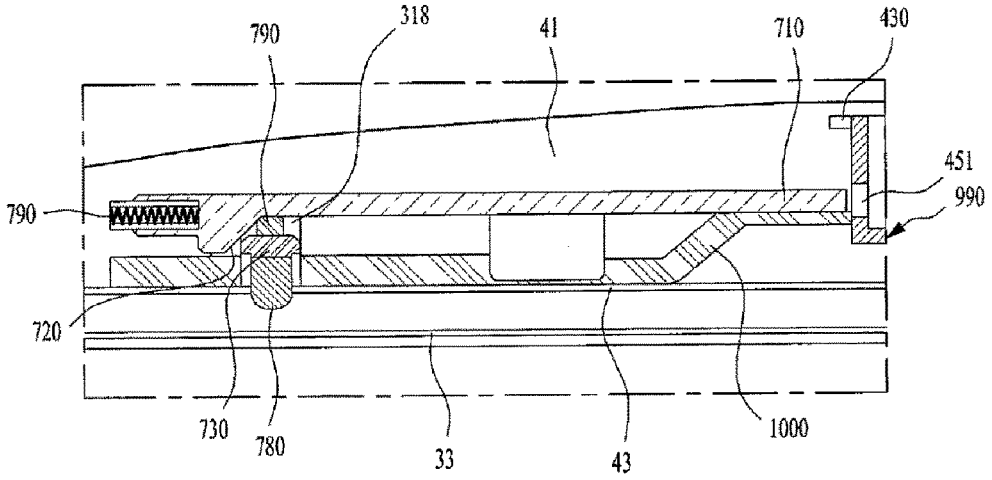
(a)
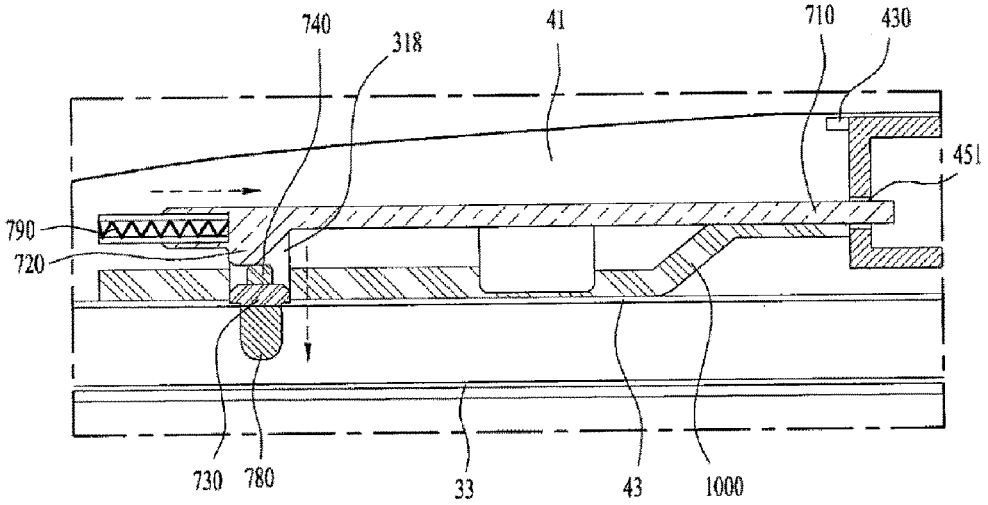
(b)

LAUNDRY TREATING APPARATUS

CROSS-REFERENCE TO RELATED PATENT APPLICATIONS

This application is a U.S. National Stage Application under 35 U.S.C. 0371 of PCT Application No. PCT/KR2015/002773, filed Mar. 20, 2015, which claims priority to Korean Patent Application No. 10-2014-0033182, filed Mar. 21, 2014, whose entire disclosures are hereby incorporated by reference.

TECHNICAL FIELD

The present invention to a laundry treating apparatus and, more particularly, to a laundry treating apparatus having a door, which is configured to open an introduction port for introducing laundry, that can be rotates so as to be opened in diverse directions.

BACKGROUND ART

Laundry treating apparatuses include washing apparatuses having only a washing function, drying apparatuses having only a drying function, and washing-and-drying apparatuses having both the washing function and the drying function. The washing apparatus and the washing-and-drying apparatus may include a tub being provided inside a cabinet, and a drum being rotatably provided inside the tub, and the drying apparatus may include a drum being rotatably provided inside a cabinet.

Generally, an introduction port, which is configured to allow laundry to be placed therein, is formed at a front portion of a main body of the laundry treating apparatus, and a door allowing the introduction port to be opened and closed is installed in the laundry treating apparatus. Additionally, when the door faces into the front portion of the laundry treating apparatus, the door may open and close the introduction port while rotating along a horizontal direction (i.e., left-and-right direction) or a vertical direction (i.e., up-and-down direction).

A structure that can open and close the introduction port of the washing apparatus by horizontally or vertically rotating the door in accordance with a user's selection has already been disclosed earlier. This is shown, for example, in Korean Patent Application No. 10-2011-0139295.

In such opening and closing structure of the door, when a rotating shaft of the door is configured as a horizontal rotating shaft or a vertical rotating shaft, a rotating shaft shifting unit, which is provided on the door, rotatably fastens (or fixes) any one of the horizontal rotating shaft and the vertical rotating shaft, which is selected by the user.

In case the user configures the horizontal rotating shaft (i.e., in case the user intends to rotate the door along the horizontal direction), the rotating shaft shifting unit is coupled to a hinge, which is installed at a lower portion of the door, so as to rotatably support the door.

At this, a problem may occur in that the rotating shaft shifting unit (i.e., one end of the rotating shaft shifting unit) cannot bear the weight of the door and becomes bent. Additionally, a problem may also occur in that, as the opening and closing of the door is repeated, the bent state or damage of the rotating shaft shifting unit may worsen.

Additionally, multiple hinge shafts are provided on the door in order to allow the door to be rotated in multiple directions (e.g., two directions). Among the multiple hinge shafts, some of the hinge shafts shall be configured to be capable of rotatably fastening the door to a cabinet of the laundry treating apparatus in accordance with the rotating direction of the door, or some of the hinge shafts shall be configured to allow the door to be detached from the cabinet. Generally, the hinge shaft is provided on the door, and a hinge shaft detachable part configured to attach or detach the hinge shaft is provided on the cabinet.

More specifically, in accordance with the rotating direction of the door, the hinge shaft configuring a rotating shaft shall be rotatably fastened to the hinge shaft detachable part, and the hinge shaft that does not configure a rotating shaft shall be removed (or detached) from the hinge shaft detachable part.

However, in accordance with the rotating direction of the door, which is configured by the user, a problem may occur in that the hinge shaft configuring the rotating shaft may be detached from the hinge shaft detachable part during the rotation of the door.

For example, in case the user wishes to rotate the door along the vertical direction (i.e., the up-and-down direction), the hinge shaft rotating the door is horizontally provided on a lower portion of the door. For example, a total of two hinge shafts may be provided, wherein each hinge shaft may be provided on each corner area of the door at the lower portion of the door. One of such two hinge shafts shall be detached from the hinge shaft detachable part, when the door is being rotated along the horizontal direction (i.e., left-and-right direction).

However, during the rotation of the door along the horizontal direction (i.e., left-and-right direction), a problem may occur in that anyone of the two hinge shafts that are intended to rotatably fix (or fasten) the door to the cabinet may be detached from the hinge shaft detachable part during the rotation of the door. In this case, another problem may follow in that the entire door may be detached from the cabinet.

DISCLOSURE OF INVENTION

Technical Problem

In order to resolve the above-described problems of the related art laundry treating apparatus, an object of the present invention is to provide a laundry treating apparatus that can prevent a rotating shaft shifting unit from being bent or damaged by supporting the rotating shaft shifting unit, which is configured to selectively and rotatably fasten the rotating shaft of the door.

Additionally, an object of the present invention is to provide a laundry treating apparatus that can prevent a hinge shaft, which is required for rotating the door along a rotating direction configured by the user, among multiple hinge shafts configured to be selectively attached/detached to/from the door in accordance with the rotating direction of the door, from being detached from the hinge shaft detachable part.

Furthermore, an object of the present invention is to provide a laundry treating apparatus that can allow the door to be stably rotated by preventing the rotating shaft from being switched during the rotation of the door.

Solution to Problem

In order to achieve the above-described object, the present invention provides a laundry treating apparatus including a cabinet configuring an external feature and being provided with a laundry introduction port; a door being aligned to open and close the introduction port; a hinge unit configuring a first rotating axis rotating the door in a first rotating direction, and a second rotating axis rotating the door in a second rotating direction, the second rotating direction corresponding to a direction different from the first rotating direction; and a rotating shaft shifting unit configured to be capable of being moved so as to rotatably fasten the door to any one of the first rotating axis and the second rotating axis, wherein the hinge unit includes a first shaft and a second shaft configuring the first rotating axis and a third shaft and a fourth shaft configuring the second rotating axis, wherein the rotating shaft shifting unit is provided with a first shifting unit being extended along a width direction of the door, and a second shifting unit being extended along a height direction of the door from one end of the first shifting unit and selectively and rotatably fastening the fourth shaft to the cabinet, and wherein the fourth shaft is provided with a protrusion protruding toward the second shifting unit, and wherein an end portion of the protrusion comes in contact with the second shifting unit.

Additionally, the fourth shaft may be formed to be extended from one side of a fourth shaft bracket, the fourth shaft bracket being installed on the door, the fourth shaft bracket may be formed to envelop at least a portion of the second shifting unit, the cabinet may include a guidance groove configured to accommodate a free end part of the second shifting unit, and, when the door is rotated in the second rotating direction at a predetermined angle, at least a portion of the fourth shaft bracket may be inserted in the guidance groove along with the free end part of the second shifting unit.

Additionally, the fourth shaft may be provided with a first side flat surface formed along a length direction of the fourth shaft and a second side flat surface formed to face into the first side flat surface.

Additionally, the first side flat surface and the second side flat surface may be formed to be parallel to one another.

Additionally, it is preferable that the cabinet is provided with a fourth shaft detachable part configured to accommodate the fourth shaft, that an receiving groove is formed in the fourth shaft detachable part, the receiving groove being configured to accommodate the fourth shaft, and that a width of an opening of the receiving groove is larger than a width between the first side flat surface and the second side flat surface.

Additionally, it is preferable that a stopper is formed on the fourth shaft detachable part, the stopper being configured to limit a rotating angle of the fourth shaft, that a third side flat surface corresponding to the first side flat surface of the fourth shaft is formed on the stopper, and that the first side flat surface establishes surface contact with the third side flat surface.

Additionally, the second shifting unit may be provided with a first side surface facing into the fourth shaft and a second side surface facing into the first side surface, the fourth shaft bracket may be provided with an extended part configured to be extended along the second side surface of the second shifting unit, and, when the door is rotated in the second rotating direction at a predetermined angle, the extended part of the fourth shaft bracket may be inserted in the guidance groove along with the free end part of the second shifting unit.

Additionally, when the door is rotated in the second rotating direction at a predetermined angle, the second shifting unit may be supported on an edge of the guidance groove by the extended part of the fourth shaft bracket.

Additionally, a fourth side flat surface may be formed on the protrusion provided on the fourth shaft, and the fourth side flat surface of the protrusion may support the second shifting unit by establishing surface contact with the second shifting unit.

Additionally, it is preferable that the fourth shaft is connected to a hinge arm, wherein the hinge arm is extended from the fourth shaft bracket.

Additionally, the fourth shaft bracket may be provided with a bracket body and the hinge arm, the hinge arm may be formed to be extended with an inclination from the bracket body and toward the fourth shaft detachable part, and the bracket body, the hinge arm, and the fourth shaft may be formed as a single body.

Additionally, the hinge arm may be configured of two arms each being spaced apart from one another at a predetermined distance, and the fourth shaft may be provided between the two arms.

Additionally, the laundry treating apparatus according to the present invention may further include a lock configured to limit movements of the rotating shaft shifting unit.

At this point, the rotating shaft shifting unit may be provided with a first shifting unit being extended along a horizontal direction, and a second shifting unit being extended along a vertical direction from one end of the first shifting unit and selectively and rotatably fastening the fourth shaft to the cabinet, and the lock may be configured to fix a position of at least any one of the first shifting unit and the second shifting unit.

Additionally, the present invention further includes a first coupling part and a second coupling part each being provided to be spaced apart from one another at a predetermined distance along a moving direction of the first shifting unit, or each being provided to be spaced apart from one another at a predetermined distance along a moving direction of the second shifting unit, and being detachably coupled to the lock, and when the door opens the introduction port, the lock may be coupled to any one of the first coupling part and the second coupling part, thereby fixing a position of at least any one of the first shifting unit and the second shifting unit.

Advantageous Effects of Invention

According to the present invention, since a rotating shaft shifting unit, which is configured to rotatably fasten a hinge shaft to a hinge shaft detachable part, is supported by a protruded part, which is protruded from the hinge shaft, the rotating shaft shifting unit may be prevented from being bent or damaged due to the weight of the door.

Additionally, bending or damage of the rotating shaft shifting unit may be further prevented from occurring by using a bracket enveloping at least a portion of the rotating shaft shifting unit.

Moreover, according to the present invention, a hinge shaft being required for rotating the door may be prevented from being detached from the hinge shaft detachable part.

Furthermore, the present invention may anticipate an effect of providing a laundry treating apparatus that can allow the door to be stably rotated by preventing the rotating shaft from being switched during the rotation of the door.

BRIEF DESCRIPTION OF DRAWINGS

FIG. 1 illustrates a perspective view of a laundry treating apparatus according to the present invention.

FIG. 2 illustrates a perspective view of a door shown in FIG. 1 being rotated along a first rotating direction.

FIG. 3 illustrates a perspective view of the door shown in FIG. 1 being rotated along a second rotating direction.

FIG. 4 illustrates an exemplary state of a second hinge being rotated along a first rotating direction.

FIG. 5 illustrates an exemplary state of a second hinge being rotated along a second rotating direction.

FIG. 6 illustrates an inside of an outer frame of the door shown in FIG. 1.

FIG. 7 illustrates a cross-sectional view of a structure of an actuator.

FIG. 8 illustrates a relationship between a first shifting unit and a first hinge shaft.

FIG. 9 and FIG. 10 illustrate movements of a second shifting unit according to an operation of an actuator.

FIG. 11 illustrates a state of the door being rotated along a second rotating direction.

FIG. 12 and FIG. 13 illustrate a lock being equipped to a first shifting unit.

FIG. 14 and FIG. 15 illustrate a lock according to another exemplary embodiment.

MODE FOR THE INVENTION

Hereinafter, a preferred embodiment of the present invention that can realize in detail the above-described object will be described with reference to the accompanying drawings.

FIG. 1 illustrates a perspective view of a laundry treating apparatus according to the present invention, FIG. 2 illustrates a perspective view of a door shown in FIG. 1 being rotated along a first rotating direction (i.e., a horizontal direction or left-and-right direction), and FIG. 3 illustrates a perspective view of the door shown in FIG. 1 being rotated along a second rotating direction (i.e., a vertical direction or up-and-down direction). Hereinafter, the description will be given with reference to FIG. 1 to FIG. 3.

The laundry treating apparatus according to the present invention includes a cabinet (3) being provided with a laundry accommodating space (R) and an introduction port (37) allowing laundry to be inserted into the laundry accommodating space, a door (4) being provided to allow the introduction port to be opened and closed, and a hinge unit (5, 6, 7) being configured to rotate the door (4) in order to allow the introduction port to be opened and closed, wherein the door (4) can be rotated in different directions.

The cabinet (3) configures an outside feature of the laundry treating apparatus, and the introduction port (37) is provided to pass through a front panel (33), which is provided on one side of the cabinet, thereby being connected to the laundry accommodating space (R). A drum may be rotatably installed in the cabinet (3). Accordingly, laundry that is inserted in the drum through the introduction port (37) may be washed or dried by the rotation of the drum.

The front panel (33) may be provided with a locking protrusion receiving part (39), wherein a locking protrusion (47) is provided on the door (4). Accordingly, by having the locking protrusion (47) accommodated in the locking protrusion receiving part (39), which is provided at the cabinet, the door (4) may close the introduction port (37).

Meanwhile, the cabinet (3) may be provided with a control panel (31), which is configured to allow the user to input control commands to the laundry treating apparatus.

The hinge unit (5, 6, 7) configure a first pivot or a first rotating axis (A), which rotates the door (4) so that the introduction port (37) can be opened and closed, and a second rotating axis (B), which rotates the door (4) so that the introduction port (37) can be opened and closed yet in a direction different from that of the first rotating axis (A). It is preferable that the first rotating axis (A) configures a vertical direction with respect to a bottom surface (32) of the cabinet (3), and it is preferable that the second rotating axis (B) configures a horizontal direction that is parallel to the bottom surface (32) of the cabinet (3).

The first rotating axis (A) is formed by using a first hinge (5) and a second hinge (6), and the second rotating axis (B) is formed by using a second hinge (6) and a third hinge (7).

FIG. 2 and FIG. 3 illustrate an exemplary case when the first rotating axis (A) is formed along a perpendicular direction (i.e., height direction or vertical direction) of the cabinet (3), and when the second rotating axis (B) is formed along a parallel direction (i.e., width direction or horizontal direction) of the cabinet (3). However, as long as the door (4) is rotated along different directions so as to open the introduction port (as long as the first rotating axis and the second rotating axis are configured to form a predetermined angle), the first rotating axis (A) and the second rotating axis (B) may be formed at diverse positions within the cabinet.

The first hinge (5) is provided with a first shaft (51) configuring the first rotating axis (A), and a first shaft detachable part (53) having a first receiving groove (531) (see FIG. 8), which is configured to accommodate the first shaft (51), formed therein. The first shaft (51) may be installed at the cabinet (3), and the first shaft detachable part (53) may be provided in the door (3). The third hinge (7) is provided with a fourth shaft (713) configuring the second rotating axis (B), and a fourth shaft detachable part (73) having a second receiving groove (731) (see FIG. 9), which is configured to accommodate the fourth shaft (714), formed therein. The fourth shaft (713) may be installed at the door (4), and the fourth shaft detachable part (73) may be provided in the cabinet (3). The second hinge (6) that can configure both the first rotating axis (A) and the second rotating axis (B) will be described in detail later on.

As shown in FIG. 2, in case the door (4) is rotated along a first rotating direction, the first hinge (5) and the second hinge (6) connect the door (4) to the cabinet (3) so that the door (4) can be rotated along the first rotating direction with respect to the cabinet (3). At this point, the door (4) may be detached from the cabinet (3) at the third hinge (7). Conversely, as shown in FIG. 3, in case the door (4) is rotated along a second rotating direction, the second hinge (6) and the third hinge (7) connect the door (4) to the cabinet (3) so that the door (4) can be rotated along the second rotating direction with respect to the cabinet (3). At this point, the door (4) may be detached from the cabinet (3) at the first hinge (5).

More specifically, the door (4) is always rotatably connected to the cabinet (3) at the second hinge (6), regardless of the rotating direction of the door (4).

The door (4) includes an inner frame (41) being provided along the direction of the front panel (33), and an outer frame (43) being joined with the inner frame and configuring the outside feature of the door (4). Additionally, the door (4) may further include a transparent unit (45), and the user may verify the laundry accommodating space (R) through the transparent unit (45).

As shown in FIG. 3, a recessed part (992), which is recessed to a predetermined depth along an extended parallel direction of the door (4) (i.e., horizontal direction or width direction of the door) is provided on an upper portion of the door (4). The recessed part (992) is extended to a predetermined length along the extended parallel direction of the door (4). The recessed part (992) may also be extended to a length equal to the horizontal length of the door (4).

An actuator (990), which can be grabbed by the user in order to apply pressure, may be provided inside the recessed part (992). The actuator (990) may be installed inside the recessed part (992) at an upper central portion of the door (4), and the user may apply pressure on the actuator (990) when rotating the door (4) in the second rotating direction.

Meanwhile, in order to rotate the door (4) in the first rotating direction, the user may grab a side handle or a side recessed part (980), which is formed on a side surface of the door (4) located opposite to the first rotating axis (A), so as to rotate the door (4) along a circumference of the first rotating axis (A). Additionally, the user may also rotate the door (4) along the circumference of the first rotating axis (A) by grabbing a portion of the recessed part (992) other than the actuator (990) (e.g., a portion of the recessed part (992) being located further away from the first rotating axis (A)).

FIG. 4 illustrates an exemplary state of a second hinge (6) being rotated along a first rotating direction, and FIG. 5 illustrates an exemplary state of a second hinge (6) being rotated along a second rotating direction. Hereinafter, operations of the second hinge (6) in accordance with the rotating direction of the door (4) will be described with reference to FIG. 4 and FIG. 5.

The second hinge (6) connects the cabinet (3) and the door (4) and, then, fixes the door (4) so that the door (4) can be selectively rotated along the first rotating direction and the second rotating direction. When the door (4) rotates along both a circumference of the first rotating axis (A) and a circumference of the second rotating axis (B), the second hinge (6) may be configured so that the door (4) can be rotatably joined with the cabinet (3).

The second hinge (6) includes a cabinet securing unit (61), which is configured to be fixed to the cabinet (3), and a door securing unit (65), which is configured to be fixed to the door (4).

The door securing unit (65) is equipped with a second shaft (651), which configures the first rotating axis (A). The door (4) may be rotated along a first rotating direction on the second shaft (651). More specifically, the door (4) may be rotated with respect to the door securing unit (65) centering on the second shaft (651).

The door securing unit (65) and the cabinet securing unit (61) are rotatably joined to one another along a third shaft (63), which configures the second rotating axis (B). The door (4) may be rotated along the second rotating direction on with the third shaft (63).

As shown in FIG. 4, the door is fixed with regard to the third shaft 63) when the door (4) is rotated along the first rotating direction.

Meanwhile, as shown in FIG. 5, the door is fixed with regard to the second shaft (651) when the door (4) is rotated along the second rotating direction.

A recess (42), which is dented to a predetermined depth, may be formed on a lower portion of the door (4). The recess (42) may provide a space that can accommodate the cabinet securing unit (61). As shown in FIG. 5, when the door (4) rotates along the second rotating direction, the recess (42) (see FIG. 4) ensures sufficient space so that interference can be prevented from occurring between the cabinet securing unit (61) and the lower portion of the door (4).

As described above, when the door rotates along the first rotating direction, the door (4) may be rotated with respect to the first shaft (51) and the second shaft (651) both configuring the first rotating axis (A). Additionally, when the door rotates along the second rotating direction, the door (4) may be rotated with respect to the third shaft (63) and a fourth shaft (713) both configuring the second rotating axis (B).

FIG. 6 illustrates an inside of an outer frame of the door shown in FIG. 1. More specifically, FIG. 6 illustrates a state when the inner frame (43) is removed from the door (4) and also illustrates other diverse elements installed in the outer frame (41). Hereinafter, a structure allowing the door (4) to be rotated along the circumference of any one of the first rotating axis (A) and the second rotating axis (B) will be described.

In FIG. 6, a line extending along a vertical direction from a left side portion of the door (4) represents the first rotating axis (A), and a line extending along a horizontal direction from a lower portion of the door (4) represents the second rotating axis (B). More specifically, in FIG. 6, since only the elements equipped to the door (4) are disclosed, among the elements of the first hinge (5), the second hinge (6), and the third hinge (7), the elements equipped to the cabinet (3) are not disclosed.

When the door (4) rotates on the first rotating axis (A) or the second rotating axis (B), the door (4) is provided with a rotating axis shifting unit (1000, 1100), which is configured to fix the door (4) to any one of the first rotating axis (A) and the second rotating axis (B).

The rotating axis shifting unit (1000, 1100) includes a first shifting unit (1000) and a second shifting unit (1100), which are configured to be moved in accordance with the operation of the actuator (990). Herein, it may also be possible to illustrate the first shifting unit (1000) and the second shifting unit (1100) as a first bar and a second bar. As indicated by the arrows shown in FIG. 6, when the actuator (990) is moved by having the user grip (or grab) the actuator (990) with his (or her) hand, the first shifting unit (1000) is fully moved toward the side direction of the door (4), and the second shifting unit (1100) is moved toward the lower direction of the door (4). More specifically, in FIG. 6, the first shifting unit (1000) is moved to the leftward direction, and the second shifting unit (1100) is moved toward the lower portion of the door (4), which is perpendicular to the moving direction of the first shifting unit (1000).

The movement path of the first shifting unit (1000) may be limited so that the first shifting unit (1000) can be moved only along the horizontal direction (i.e., a left-and-right direction or width direction of the door). Additionally, the movement path of the second shifting unit (1100) may be limited so that the second shifting unit (1100) can be moved only along the vertical direction (i.e., an up-and-down direction or height direction of the door).

An inclined surface (1101) is formed on an upper portion of the second shifting unit (1100), wherein the inclined surface (1101) allows the second shifting unit (1100) to move downward (i.e., along a vertical direction) with respect to a horizontal moving distance of the first shifting unit (1000). Since the inclined surface (1101) has a tapered form, wherein the upper portion is narrow and the lower portion is wide, when the first shifting unit (1000) moves toward the right side, the second shifting unit (1100) moves downward. More specifically, the horizontal movement of the first shifting unit (1000) may change its moving direction to the vertical movement of the second shifting unit (1100).

As described above, due to the operation of the actuator (990) (i.e., the application of pressure), the first shifting unit (1000) moves along the horizontal direction, and the second shifting unit (1100) moves along the vertical direction.

More specifically, when the door (4) rotates along the first rotating direction, the first shifting unit (1000) secures (or fixes) the door (4) to the cabinet (3), so that the joined state of the door (4) and the cabinet (3) is maintained on the first rotating axis. Most particularly, when the door (4) rotates along the first rotating direction, the first shifting unit (1000) secures (or fixes) the door (4) to the cabinet (3), so that the rotatably joined state of the door (4) and the cabinet (3) is maintained on the first hinge (5).

The first shifting unit (1000) is placed on one end of the actuator (990), thereby allowing the first shifting unit (1000) to be moved in accordance with the movement of the actuator (990). Meanwhile, in case a force being applied to the first shifting unit (1000) is removed (or eliminated), a first elastic member (1030) allowing the first shifting unit (1000) to return to its initial position is provided on one side of the first shifting unit (1000). At this point, it is preferable that the first elastic member (1030) corresponds to a tension spring. More specifically, in case a force pushing the first shifting unit (1000) rightward is applied, the first elastic member (1030) is tensioned due to the rightward movement of the first shifting unit (1000). Conversely, in case a force being applied to the first shifting unit (1000) is removed (or eliminated), the first elastic member (1030) may pull the first shifting unit (1000) leftward so as to return the first shifting unit (1000) to its initial position.

Additionally, in case a force being applied to the second shifting unit (1100) is removed (or eliminated), a second elastic member (1130) allowing the second shifting unit (1100) to return to its initial position may be provided on one side of the second shifting unit (1100). More specifically, the first shifting unit (1000) moves rightward, and the second shifting unit moves downward, in accordance with the movement of the actuator (990). At this point, in case a force being applied to the first shifting unit (1000) is removed (or eliminated), the force being applied to the second shifting unit (1100) is also removed, and, accordingly, the second elastic member (1130) is pulled upward so as to allow the second shifting unit (1100) to return to its initial position. It is also preferable that the second elastic member (1130) corresponds to a tension spring.

Additionally, it may also be possible to be equipped only with the second elastic member (1130) without the first elastic member (1030). More specifically, even if the first elastic member (1030) does not exist, if the second shifting unit (1100) is pulled upward by the second elastic member (1130), the first shifting unit (1000) is pushed leftward due to the inclined surface (1101), which is formed on an upper portion of the second elastic member (1130), thereby returning to its initial position.

Meanwhile, the door (4) may be further provided with a lock (70) restricting (or limiting) the horizontal movement of the first shifting unit (1000). The lock (70) will hereinafter be described in detail with reference to other drawings.

FIG. 7 illustrates a cross-sectional view of a structure of an actuator (990). A movement of a first shifting unit in accordance with the structure of the actuator and the operation of the actuator will be described with reference to FIG. 7.

The actuator (990) includes a pivot shaft (995) configured to pivot the actuator (990), a first part (996) configured to be extended from the pivot shaft toward a bottom (993) of a recessed part (992), and a second part (997) configured to pass through the bottom (993) of the recessed part (992) from an end portion of the first part (996) and to extend below the bottom (993) of the recessed part (992). At this point, the first part (996) and the second part (997) may be collectively formed as a single body. Additionally, the first part (996) of the actuator (990) may be provided with a pressure point (998), on which pressure is applied by the user, and the pressure point (998) is positioned to be lower than the pivot shaft (995).

More specifically, the pressure point (998) may be positioned at any point as long as the pressure point (998) located between the pivot shaft (995) and the bottom (993) of the recessed part (992). Herein, the term "pressure point" represents a point on which pressure is applied by the user from the actuator (990) (i.e., the first part (996) of the actuator (990)).

Additionally, a protruded piece (1002) protruding so as to have an inclination from a predetermined height is formed on the first shifting unit (1000) of the rotating shaft shifting unit, and a protruded pressure applying part (991) facing into the protruded piece (1002) is formed on a free end part of the second part (997) of the actuator (990). More specifically, the protruded piece (1002) may be protruded so as to have an inclination from a center portion of the first shifting unit (1000), and the pressure applying part (991) may be protruded so as to have into the protruded piece (1002).

Accordingly, when the user grabs the actuator (990) with his (or her) hand, and when the user applies pressure on the first part (996) of the actuator (990) (i.e., the pressure point (998) of the first part (96)), the actuator (990) rotates clockwise (if viewed from the location of the first hinge (5)) centering on the pivot shaft (995). More specifically, when pressure is applied on the pressure point (998) of the actuator (990) by the user, the first part (996) and the second part (997) of the actuator (990) rotate clockwise (along the direction of the left side arrow shown in FIG. 7) centering on the pivot shaft (995).

Accordingly, the pressure applying part (991) formed on the second part (997) of the actuator (990) pushes the protruded piece (1002) of the first shifting unit (1000), and, then, the first shifting part (1000) moves along the horizontal direction of the door (4) (i.e., width direction or lateral direction of the door). For example, referring to FIG. 6, the protruded piece (1002) of the first shifting unit (1000) may be formed to have an inclination so that the first shifting unit (1000) can move rightward when pressure is applied by the pressure applying part (991). More specifically, as shown in FIG. 6, the protruded piece (1002) may be formed to have an inclination toward the right side.

Additionally, FIG. 8 illustrates a relationship between a first shifting unit (1000) and a first hinge (5), and this will hereinafter be described with reference to FIG. 7 and FIG. 8.

When pressure is applied on the actuator (990) by the user, and when the first shifting unit (1000) moves along a lateral direction (rightward in FIG. 6), a first receiving groove (531) accommodating a first shaft (51) is opened. Accordingly, the first shaft (51) may be detached (or removed) from the first receiving groove (531).

Meanwhile, as shown in FIG. 8, in case the first shifting unit (1000) is closing the first receiving groove (531), since the first shaft (51) cannot be released from the first receiving groove (531), the door (4) is rotatably secured to the cabinet (3) while centering on the first shaft (51).

However, if the first shifting unit (1000) is moved rightward to due to the above-described operation, the first shaft (51), which is accommodated in the first receiving groove (531), is released from the receiving groove (531), and, as a result, the door (4) and the cabinet (3) cannot be joined to one another by using the first hinge (5), which corresponds to the first shaft (51).

More specifically, in case the user wishes to rotate the door (4) along the first rotating direction, the door (4) is required to be rotated by centering on the first shaft (51), which corresponds to a portion of the first rotating axis. Therefore, the fixed state of the door (4) and the first shaft (51) should be maintained.

Accordingly, in this case, the user may rotate the door (4) along the circumference of the first rotating axis (A) by grabbing a side handle, which is formed on a side surface of the door (4), by using his (or her) hand, or the user may rotate the door (4) along the circumference of the first rotating axis (A) by grabbing a portion of the recessed part (992) other than the actuator (990) (e.g., a portion of the recessed part (992) being located further away from the first rotating axis (A)). At this point, since pressure is not applied to the actuator (990), the first shifting unit (1000) maintains a stopped (or immobile) state, and the first shifting unit (1000) maintains a state of sealing (or closing) the first receiving groove (531). Therefore, the first shaft (51) is not detached (or removed) from the first receiving groove (531), and, by forming the first rotating axis, the door (4) may be rotated along the first rotating direction.

FIG. 9 and FIG. 10 illustrate movements of a second shifting unit according to an operation of actuator. More specifically, FIG. 9 illustrates a relation between the second shifting unit (1100) and the third hinge (7) in a state when pressure is not applied to the actuator (i.e., a state when the second shifting unit is not moved downward), and FIG. 10 illustrates a relation between the second shifting unit (1100) and the third hinge (7) in a state when pressure is applied to the actuator (i.e., a state when the second shifting unit is moved downward) in order to rotate the door along the second rotating direction.

The third hinge (7) includes a fourth shaft (713) configuring the second rotating axis, and a fourth shaft detachable part (73) having a second receiving groove (731) that can attach/detach the fourth shaft (713). The fourth shaft (713) is provided on the door (4), and the fourth shaft detachable part (73) is provided on the cabinet (3), and the fourth shaft (713) may be detachably attached (or fixed) to the fourth shaft detachable part (73).

More specifically, the fourth shaft (713) may be formed to extend from one side of a fourth shaft bracket (700), which is installed on the door (4). For example, the fourth shaft bracket (700) may be equipped with a bracket body (701) and a hinge arm (702), which extends with an inclination from the bracket body (701) and toward the fourth shaft detachable part (73). The hinge arm (702) may be configured of two arms being spaced apart from one another at a predetermined distance, and the fourth shaft (73) may be provided between the two hinge arms (702). The bracket body (701), the hinge arm (702), and the fourth shaft (713) may be formed as a single body or may each be formed separately and then joined afterwards.

The fourth shaft bracket (700) is formed to envelop at least a portion of the second shifting unit (1100). More specifically, the bracket body (701) of the fourth shaft bracket (700) may be formed to envelop at least a portion of the second shifting unit (1100). For example, a guidance hole or guidance path (not shown), which the second shifting unit (1100) can vertically pass through downward (i.e., a direction facing the lower portion of the door (4)) may be formed on the bracket body (701). At this point, it is preferable that the free end part of the second shifting unit (1100) (i.e., lower end part of the second shifting unit (1100)) is formed to be extended lower than the bracket body (701), so that the free end part can be prevented from being enveloped by the bracket body (701).

Additionally, the fourth shaft (713) may be provided with a protrusion (703) protruding toward the second shifting unit (1100). It is preferable that the protrusion (703) is protruded along the entire length direction of the fourth shaft (713). Moreover, it is also preferable that an end portion of the protrusion (703) is formed to come in contact with second shifting unit (1100). In other words, the protrusion (703) may support the second shifting unit (1100) by coming in contact (or touching) a side surface of the second shifting unit (1100). More specifically, it is preferable that a fourth side flat surface (704) is formed on the protrusion (703) and that the fourth side flat surface (704) supports the second shifting unit (1100) by making surface contact with one side surface of the second shifting unit (1100). The fourth side flat surface (704) may support the second shifting unit (1100) by always establishing surface contact with one side surface of the second shifting unit (1100) regardless of the movement or non-movement of the second shifting unit (1100). Also, even when the door (4) is rotated, the fourth side flat surface (704) of the protrusion (703) may maintain the state of surface contact with the one side surface of the second shifting unit (1100). This is because the fourth shaft (713), the protrusion (703), and the second shifting unit (1100) rotate all together when the door (4) rotates. Due to such structure of the protrusion (703), bending of the second shifting unit (1100) may be prevented from occurring at the free end part area of the second shifting unit (1100).

Additionally, in the cabinet (3), a guidance groove (732), which is configured to rotatably guide the free end part of the second shifting unit (1100), may be formed on a part being in correspondence with the free end part of the second shifting unit (1100). For example, the fourth shaft detachable part (73) being installed in the cabinet (3) may include the guidance groove (732).

In FIG. 9, since the door (4) is in a state of closing the introduction port (37), the fourth shaft (713) is completely inserted in the second receiving groove (731). At this point, in case the user rotates the door (4) along the first rotating direction, the fourth shaft (713) may be ejected from the second receiving groove (731) along a horizontal direction (i.e., a direction of the arrow shown in FIG. 9). More specifically, since the second shifting unit (1100) does not completely seal the horizontal opening of the second receiving groove (731), the fourth shaft (713) may be moved along the horizontal direction from the second receiving groove (731) without interfering from the second shifting unit (1100).

FIG. 10 illustrates a state of the second shifting unit (1100) shown in FIG. 9 being moved downward. In case the user wishes to rotate the door (4) along the second rotating direction, the user applies pressure on the actuator (990), i.e., the pressure point (998) of the actuator (990). As shown in FIGS. 6 and 7, when pressure is applied on the actuator (990), the first shifting unit (1000) is moved rightward. And, the second shifting unit (1100) is moved downward.

Accordingly, the free end part of the second shifting unit (1000) is inserted in the guidance groove (732). More specifically, as shown in FIG. 10, the second shifting unit (1100) moves to a position lower that the position shown in FIG. 9. Accordingly, the second shifting unit (1100) seals the second receiving groove (731), thereby preventing the fourth shaft (713) from being ejected from the second receiving groove (731).

When the actuator (990) is being operated (i.e., when pressure is applied), the first shifting unit (1000) is also moved rightward, and the first shaft (51) is detached from the first receiving groove (531), thereby separating the door (4) and the cabinet (3) from one another at the first hinge (5). Thus, the door (4) may be rotated along the second rotating direction.

Conversely, in case the user wishes to rotate the door (4) along the first rotating direction, pressure is not applied on the actuator (990) by the user. Accordingly, the first shifting unit (1000) and the second shifting unit (1100) maintain their initial states without being operated. More specifically, since the second shifting unit (1100) is positioned in the position shown in FIG. 9 without moving downward, the fourth shaft (713) may be detached from the second receiving groove (731). Thus, the door (4) may be rotated along the first rotating direction.

FIG. 11 illustrates a state of the door being rotated along a second rotating direction. More specifically, when pressure is applied on the actuator (990) by the user in order to rotate the door (4) along the second rotating direction, the second shifting unit (1100) is moved downward so as to rotatably fix (or secure) the fourth shaft (713) to the fourth shaft detachable part (73), which is installed in the cabinet (3). At this point, the user may rotate the door (4) along the second rotating direction so as to open the door (4).

Referring to FIG. 11, when the door (4) is rotated along the second rotating direction, the fourth shaft bracket (700) and the second shifting unit (1100), which are installed in the door (4), are also rotated along with the door (4). When rotating to a predetermined angle along the rotating direction of the door (4), at least a portion of the fourth shaft bracket (700) may be inserted in the guidance groove (732) along with the free end part of the second shifting unit (1100).

More specifically, the second shifting unit (1100) is provided with a first side surface (1102), which faces into the fourth shaft (713), and a second side surface (1103), which is located opposite to the first side surface (1102), and the fourth shaft bracket (700) may be further provided with an extended part (705), which is configured to extend along the second side surface (1103) of the second shifting unit (1100). The extended part (705) may be extended from the end portion of the bracket body (701) and may be provided to have a width identical to the width of the first side surface (1102) of the second shifting unit (1100) or a width larger than the width of the first side surface (1102). Evidently, it will be preferable that the bracket body (701) and the extended part (705) are formed as a single body.

Accordingly, when the door (4) is rotated along the second rotating direction, the extended part (705) of the fourth shaft bracket (700) may be inserted in the guidance groove (732) along with the free end part of the second shifting unit (1100). More specifically, although the extended part (705) is not inserted into the guidance groove (732) before the door (4) is rotated along the second rotating direction, the extended part (705) may be inserted inside the guidance groove (732) as the door (4) rotates along the second rotating direction. At this point, when the door (4) is rotates to a predetermined angle, and when the second shifting unit (1100) and the extended part (705) are inserted inside the guidance groove (732) accordingly, the second shifting unit (1100) and the extended part (705) may be supported by an edge (733) of the guidance groove (732). In this case, the extended part (705) is directly supported by the edge (733), and the second shifting unit (1100) is supported by the extended part (705).

Accordingly, when the door (4) is opened by being rotated along the second rotating direction, the second shifting unit (1100) may be prevented from being bent or damaged by the weight of the door (4).

Meanwhile, collectively referring to FIGS. 9 to 11, the fourth shaft (713) may be provided with a first side flat surface (714) and a second side flat surface (715) being formed on the opposite side of the first side flat surface (714). The first side flat surface (714) and the second side flat surface (715) may be parallel. The first side flat surface (714) and the second side flat surface (715) may be formed along the length direction of the fourth shaft (713).

More specifically, it is preferable that the first side flat surface (714) and the second side flat surface (715) are formed along the entire length direction of the fourth shaft (713). At this point, it is preferable that the first side flat surface (714) and the second side flat surface (715) are formed to be parallel to one another.

Additionally, it is preferable that a width of an opening of the second receiving groove (731), which is formed on the fourth shaft detachable part (73) (refer to reference numeral "d" of FIGS. 9 and 11), is formed to be larger than the width between the first side flat surface (714) and the second side flat surface (715). More specifically, the opening of the second receiving groove (731) may be configured to have any height or width (d), as long as the height or width (d) is sufficient enough to horizontally insert the fourth shaft (713), which is provided with the first side flat surface (714) and the second side flat surface (715), into the second receiving groove (731).

For example, as shown in FIG. 9, when the fourth shaft (713) is inserted into the second receiving groove (731), the first side flat surface (714) and the second side flat surface (715) are inserted inside the second receiving groove (731), so that the first side flat surface (714) and the second side flat surface (715) can be parallel to a bottom surface to which the laundry treating apparatus is to be installed or parallel to a bottom (32) of the cabinet (3). As described above, since the first and second side flat surfaces (714, 715) are formed on the fourth shaft (713), the width (d) of the opening of the second receiving groove (731) may be formed to be smaller than the case when the first and second side flat surfaces (714, 715) are not formed on the fourth shaft (713).

Additionally, a stopper (74) configured to limit a rotating angle of the fourth shaft (713) may be formed on the fourth shaft detachable part (73). More specifically, the stopper (74) may limit the rotation of the fourth shaft (713), so that the fourth shaft (713) can be prevented from rotating at a predetermined angle or more. A third side flat surface (741) being in correspondence with the first side flat surface (714) may be formed on the stopper (74). Accordingly, when the fourth shaft (713) rotates at a predetermined angle, surface contact is established between the first side flat surface (714) and the third side flat surface (741), thereby allowing the rotation of the fourth shaft (713) to be stopped.

Meanwhile, since the width (d) of the opening of the second receiving groove (731) is greater than the distance between the first side flat surface (714) and the second side flat surface (715) of the fourth shaft (713), the fourth shaft (713) may be easily inserted in the second receiving groove (731). However, when the door (4) rotates, and when the fourth shaft (713) rotates within the second receiving groove (731) accordingly, the fourth shaft (713) cannot be ejected from the second receiving groove (731). This is because the width (D) of a rounding part, which is formed between the first side flat surface (714) and the second side flat surface (715) of the fourth shaft (713), is larger than the width (d) of the opening of the second receiving groove (731).

More specifically, the fourth shaft (731) may be configured to have a cylindrical shape being provided with the first side flat surface (714) and the second side flat surface (715).

Accordingly, the side surface of the fourth shaft (731) excluding the first side flat surface (714) and the second side flat surface (715) is entirely treated with a rounding process. The width (D) of the rounding part of the fourth shaft (731), which is treated with the above-described rounding process, is greater than the width (d) of the opening of the second receiving groove (731).

Therefore, when the fourth shaft (713) rotates after being inserted in the second receiving groove (431), the fourth shaft (713) cannot be detached (or ejected) from the second receiving groove (731). As described above, due to the configuration of the first side flat surface (714) and the second side flat surface (715), which are formed on the fourth shaft (731), the fourth shaft (731) may be prevented from being detached (or ejected) from the second receiving groove (731) during the rotation of the door (4).

The present invention will not be limited only to the above-described exemplary embodiment, and, therefore, as described in the appended claims, variation and modification may be realized by anyone skilled in the field to which the present invention belongs, and such variation and modification will belong to the scope of the present invention.

Meanwhile, a laundry treating apparatus having only the above-described structure is disadvantageous in that, when the door (4) is rotated based upon the first rotating axis (A), and when the user presses on the pressure point (998) of the actuator (990), the first shaft (51) may be separated (or detached) from the first receiving groove (531) of the first shaft (51).

Therefore, in order to resolve the above-described disadvantages, the laundry treating apparatus according to the present invention may further include a lock (70), which is configured to secure positions of the first shifting unit (1000) or the second shifting unit (1100) (i.e., to lock the first shifting unit or the second shifting unit), when the door (4) is opened to expose the introduction port (37) (i.e., when the door is separated from the front panel (33)). The features and characteristics of the lock (70), which will hereinafter be described in detail, may be applied to all exemplary embodiments shown in FIGS. 1 to 13.

A shown in FIG. 12, the lock (70) is provided inside the door (4), and the lock (70) may include a lock body (710) configured to be movable along a thickness direction (T) of the door (4), a body pressure applying part (730) provided in the lock body (710) and configured to be exposed outside of the door (4) by passing through an inner frame (43), and a shifting unit shifting unit securing part (770) detachably fixed to the first shifting unit (1000) in accordance with whether or not the lock body (710) is being operated.

In case the above-described lock (70) is provided inside the door (4), an outer frame (41) is further provided with a lock body receiving groove (317), wherein the lock body (710) is accommodated, and an inner frame (43) is further provided with a frame pass-through hole (313, see FIG. 13), which the body pressure applying part (730) passes through, and the first shifting unit (1000) is further provided with a coupling part (617) to which the shifting unit securing part (770) is joined.

The lock body receiving groove (317) corresponds to a means for guiding movements of the lock body (710), and the lock body receiving groove (317) may be provided as a hollow bar form, wherein a surface facing the inner frame (43) is opened.

The lock body receiving groove (317) may be provided at any position within the outer frame (41) as long as back-and-forth movements of the lock body (710) do not interfere with the first shifting unit (1000).

FIG. 12 illustrates an exemplary case when the lock body receiving groove (317) is located above the first shifting unit (1000), and, herein, a body supporting part (790), which is configured to elastically support the lock body (710), is provided inside the lock body receiving groove (317), and the body supporting part (790) provides the lock body (710) with an elastic force that pushes the lock body (710) toward the inner frame (43).

Meanwhile, when the lock body (710) is provided above the first shifting unit (1000) based upon a height direction (H) of the door, the shifting unit securing part (770) may be provided in a body flange (750), which is configured to be extended toward a space between the first shifting unit (1000) and the outer frame (41) within the lock body (710).

More specifically, as shown in FIG. 13, the body flange (750) is located between the first shifting unit (1000) and the outer frame (41) by extending toward the lower portion of the door (4) within the lock body (710), and the shifting unit securing part (770) may be provided to protrude toward a coupling part (617), which is provided to the first shifting unit (1000) within the body flange (750).

The coupling part (617) may be provided as a first coupling part (617*a*) and a second coupling part (617*b*), which are provided in accordance with a width direction (W) of the door, and, herein, it is preferable that a distance between a first free end (1000*e*) of the first shifting unit and the second coupling part (617*b*) is provided to be longer than a distance between the first free end (1000*e*) of the first shifting unit and the first coupling part (617*a*).

Each of the coupling parts (617*a*, 617*b*) may be provided as a coupling hole, which is provided to allow the first shifting unit (1000) to pass through, or as a coupling groove, wherein the first shifting unit (1000) is provided in a concavely curved (or dented) shape, and, herein, FIGS. 12 and 16 illustrate exemplary embodiments of a case when the coupling part is provided as a coupling hole.

The shifting unit securing part (770) may be provided with a first protruding fastener (771), which is provided by being provided to protrude from the body flange (750), and, herein, the first protruding fastener (771) may be inserted in any one of the first coupling part (617*a*) and the second coupling part (617*b*) in accordance with the position of the first shifting unit (1000). More specifically, in case the widths (w1) of the first coupling part (617*a*) and the second coupling part (617*b*) are equal to one another, the width (w2) of the first protruding fastener (771) becomes equal to or smaller than the width (w1) of the coupling part.

Meanwhile, a moving distance of the first shifting unit (1000) along the width direction (W) of the door (4) may vary depending upon a pressure level according to which the user applies pressure on the pressure point (998) of the actuator (990). Accordingly, in case the shifting unit securing part (770) is only provided with the first protruding fastener (771), if the user does not press on the pressure point (998) of the actuator (990) sufficiently, there may occur a problem in that the first protruding fastener (771) cannot be coupled with any one of the two coupling parts (617*a*, 617*b*).

In order to prevent this, in the lock (70) provided in the present invention, the first protruding fastener (771) may be provided with a second protruding fastener (772), which is configured to have a width (w3) that is smaller than the width (w2) of the first protruding fastener (771).

If the second protruding fastener (772) is provided at a center of an upper surface of the first protruding fastener (771), or if the second protruding fastener (772) is provided at a corner of the upper surface of the first protruding fastener (771), wherein the corner faces into the first free end (1000*e*) of the first shifting unit (i.e., wherein the corner faces into the first hinge (5)), a distance at which the first shifting unit (1000) is required to move in order to allow the first coupling part (617*a*) to be moved above the second protruding fastener (772), which is located be low the second coupling part (617*b*), is shorter than a distance at which the first shifting unit (1000) is required to move in order to allow the first coupling part (617*a*) to be moved above the first protruding fastener (771), which is located be low the second coupling part (617*b*).

Accordingly, when the second protruding fastener (772) having a smaller width (w3) than the width of the first protruding fastener is provided to the first protruding fastener (771), the location of the shifting unit securing part (770) may be shifted from the second coupling part (617*b*) to the first coupling part (617*a*), even by applying a small level of pressure on the pressure point (998) of the actuator (990), the shifting unit securing part (770) may be easily coupled to the coupling part (671).

A process of opening the introduction port (37) by the door (4) provided with a lock (70) and a process of shifting the rotating shaft will be described as follows.

As shown in (b) of FIG. 13, when the door (4) rotating through the second rotating axis (B) closes the introduction port (37), since pressure is applied on the body pressure applying part (730) by the front panel (33), the lock body (710) moves toward the outer frame (41) within the lock body receiving groove (317). At this point, the elastic supporting part (790) is compressed by the lock body (710).

When the lock body (710) moves toward the outer frame (41) within the lock body receiving groove (317), the shifting unit securing part (770) is ejected from the first coupling part (617*a*), and the first shifting unit (1000) moves toward the first hinge (5) by the first elastic member (1030).

When the first shifting member (1000) moves toward the first hinge (5) by the first elastic member (1030), the second coupling part (617*b*) is located above the shifting unit securing part (770), and the first free end part (1000*e*) of the first shifting unit (1000) is in a state of preventing the first shaft (51) from being detached from the first accommodation home, and the first free end part (1000*e*) of the second shifting unit (1100) is in a state of being ejected from the guidance groove (732).

In this state, instead of pressing on the pressure point (998) of the actuator (990), when the user places his (or her) hand inside the recessed part (992) and pulls the door (4) or pulls the side handle (980), the door (4) rotates on the first rotating axis (A).

When the door begins to rotate based upon the first rotating axis (A), since the contacting state between the body pressure applying part (730) and the front panel (33) is released, an external force (or outside force) applying pressure on the body pressure applying part (730) toward the outer frame (41) disappears.

Accordingly, due to the recovery force of the elastic supporting part (790), the lock body (710) moves toward the inner frame (43), and, when the lock body (710) moves toward the inner frame (43), the shifting unit securing part (770) is inserted in the second coupling part (617*b*).

When the shifting unit securing part (770) is inserted in the second coupling part (617*b*), the position of the first shifting unit (1000) becomes fixed, and, therefore, even if the user presses on the pressure point (998) of the actuator (990) while the door (4) is being rotated through the first rotating axis (A), the first shaft (5) is not detached (or separated) from the first receiving groove (531).

Meanwhile, when the door (4), which rotates through the first rotating axis (A), closes the introduction port (37), pressure is applied on the body pressure applying part (730) by the front panel (33), and the lock body (710) moves toward the outer frame (41) within the lock body receiving groove (317). Accordingly, the shifting unit securing part (770) is ejected from the second coupling part (617*a*) (i.e., the lock state of the first shifting unit (1000) is released).

In the above-described state, when the user presses on the actuator (990), a second free end (10000 of the first shifting unit (1000) pushes the inclined surface (1101), which is provided on a second free end (1100*f*) of the second shifting unit (1100). Accordingly, the first free end (1000*e*) of the first shifting unit opens the first receiving groove (531), so that the first shaft (51) can be detached from the first receiving groove (531), and a first free end (1100*e*) of the second shifting unit is inserted in the guidance groove (732), and the first coupling part (617*a*) may be positioned in front of the shifting unit securing part (770).

At this point, in a state when pressure is being applied on the actuator (990), when the door (4) is pulled, the door (4) begins to rotate based upon the second rotating axis (B).

When the door (4) begins to rotate based upon the second rotating axis (B), the contacting state between the body pressure applying part (730) and the front panel (33) is released. When the external force applying pressure on the body pressure applying part (730) toward the outer frame (41) disappears, the shifting unit securing part (770) is inserted in the first coupling part (617*a*), thereby enabling a state of having the first shifting unit (1000) apply pressure on the second shifting unit (1100).

Accordingly, in the present invention, even if the pressure point (998) of the actuator (990) does not maintain its pressed state when the door (4) rotates through the second rotating axis (B), during the rotation of the door (4), the fourth shaft (714) may be prevented from being detached from the fourth shaft detachable part (73) (i.e., the fourth shaft (714) may be prevented from being detached for the second receiving groove (731)).

Meanwhile, although the description provided above on the lock (70) corresponds to a description that is based upon a case when the shifting unit securing part (770) is being provided in order to fix (or secure) the position of the first shifting unit (1000), the lock (70) that is provided in the present invention may also be provided in order to fix (or secure) the position of the second shifting unit (1100).

In this case, the first coupling part (617*a*) and the second coupling part (617*b*) shall be provided in the second shifting unit (1100), and the coupling parts are provided so that the distance from the first free end (1100*e*) of the second shifting unit to the first coupling part is shorter than the distance from the first free end (1100*e*) to the second coupling part. Therefore, when the shifting unit securing part (770) is coupled to the first coupling part, the door (4) is coupled to the first rotating axis (A), and when the shifting unit securing part (770) is coupled to the second coupling part, the door (4) is coupled to the second rotating axis (B).

FIG. 14 illustrates a case when the above-described lock (70) is provided to fasten the actuator (990), and FIG. 15 illustrates an exemplary case when the body pressure applying part (730) can perform back-and-forth movements along the thickness direction (T) of the door. In case the lock (70) is being provided as a structure for fastening the actuator (990), the actuator (990) is provided with a first body coupling part (451) detachably coupling the lock (70) to the actuator (990), and a second body coupling part (453) located below the body coupling part (451), and, herein, the first body coupling part (451) and the second body coupling part (453) may be provided to be positioned on a circular arc centering on a body rotating shaft (430).

As shown in FIGS. 14 and 15, the lock (70) according to this exemplary embodiment may include a lock body (710), which is provided to be capable of performing back-and-forth movements along a width direction (W) of the door (4), and which can be inserted in each of the first body coupling part (451) and the second body coupling part (453), a body supporting part (790), which is configured to elastically support the lock body (710) while applying pressure on the lock body (710) toward a direction where a actuator (990) is located, an inclined body surface (720) being provided to the lock body (710), and a body pressure applying part (730), which is configured to move the lock body (710) by contacting the inclined body surface (720), when the door (4) closes the introduction port (37).

The body pressure applying part (730) may be provided in a structure allowing back-and-forth movements to be performed along the thickness direction (T) of the door within the door (4), and the body pressure applying part (730) may also be provided with front panel (33) so as to be capable of applying pressure on the inclined body surface (720), when the door (4) closes the introduction port (37).

FIG. 15 illustrates an exemplary case when the body pressure applying part (730) can perform back-and-forth movements along the thickness direction (T) of the door.

The door (4) may be further provided with a pressure applying part guider (318), which is configured to guide back-and-forth movements of the body pressure applying part (730). The pressure applying part guider (318) shall be provided in order to prevent interference with rotating shaft shifting unit (6), and FIG. 15 illustrates an exemplary case when the pressure applying part guider (318) is positioned above the first shifting unit (1000).

Meanwhile, the body pressure applying part (730) may include a first pressure applying part (740) being provided to protrude from the body pressure applying part (730) toward the inclined body surface (720), and a second pressure applying part (780) being provided to protrude from the body pressure applying part (730) toward the front panel (33).

In this case, when the door (4) closes the introduction port (37), pressure is applied on the second pressure applying part (780) by the front panel (33). Accordingly, the first pressure applying part (740) comes in contact with the inclined body surface (720), thereby being capable of moving the lock body (710) toward a direction further away from the actuator (990) ((a) of FIG. 15).

Meanwhile, when the door (4) opens the introduction port (37), the external force being supplied to the second pressure applying part (780) disappears. Accordingly, since the lock body (710) moves toward the actuator (990) by the body supporting part (790), and since the first pressure applying part (740) moves toward the inner frame (43) due to the inclined body surface (720), the second pressure applying part (780) may return to the state of being exposed outside of the inner frame (43) (its initial position, (b) of FIG. 15).

In order to help the body pressure applying part (730) return to its initial position, the door (4) may be further provided with a pressure applying part supporting part (not shown), which is configured to elastically support the body pressure applying part (730).

In this exemplary embodiment, when the door (4) is in a state of closing the introduction port, the first shifting unit (1000) also prevents the first shaft (51) from being ejected from the receiving groove (531), and the lock body (710) does not lock the actuator (990) (the lock body (710) is not inserted in the first body coupling part (451), (a) of FIG. 15).

When the door (4) rotates by centering on the first rotating axis (A) and opens the introduction port, since the external force being supplied to the second pressure applying part (780) disappears, a free end of the lock body (710) is inserted in the first body coupling part (451) by the body supporting part (790).

Accordingly, in this exemplary embodiment also, when the door (4) rotates by centering on the first rotating axis (A), by operating the actuator (990), the first shaft (51) may be prevented from being ejected from the first receiving groove (531).

Meanwhile, in case the door (4) rotates by centering on the second rotating axis (B), the free end of the lock body (710) is coupled with the second body coupling part (453) and, then, locks the actuator (990).

In order to allow the door (4) to rotate by centering on the second rotating axis (B), the user is required to move the first shifting unit (1000), so that pressure can be applied on the second shifting unit (1100) by the actuator (990).

As described above, since the second body coupling part (453) is provided at a lower portion of the first body coupling part (451) on a circumference centering on the body rotating shaft (430) and passing through the first body coupling part (451), when the user rotates the actuator (990), the first body coupling part (451) deviates from the back-and-forth movement path of the lock body (710), and the second body coupling part (453) is positioned on the back-and-forth movement path of the lock body (710).

In the above-described state, when the user separates the door (4) from the front panel (33), the free end of the lock body (710) moves toward the actuator (990) so as to be inserted in the second body coupling part (453).

Drawing (b) of FIG. 14 illustrates an exemplary case when each of the first body coupling part (451) and the second body coupling part (453) is provided in the form of a hole passing through the actuator (990) or in the form of a groove concavely dented on the surface of the actuator (990).

However, as long as the first body coupling part (451) and the second body coupling part (453) can realize the above-described functions, the first body coupling part (451) and the second body coupling part (453) may be modified intro diverse structures, and (c) of FIG. 14 illustrates an exemplary case when at least one of the first body coupling part and the second body coupling part is provided as a groove at the edge of the actuator (990).

Furthermore, the lock (70) being provided in the present invention may also be provided to the body pressure applying part (730), the first pressure applying part (740) being provided to protrude from the body pressure applying part (730) toward body pressure applying part (730), and the second pressure applying part (780) being provided in the front panel (33) and applying pressure on the first pressure applying part (740) toward the direction of the inclined body surface (720) when the door (4) closes the introduction port.

In this case, the inner frame (43) of the door shall be further provided with an insertion hole in which the second pressure applying part (780) is inserted when the door (4) closes the introduction port (37), and the body pressure applying part (730) shall be provided to be available for contact when the second pressure applying part (780) is inserted in the insertion hole.

The present invention will not be limited only to the above-described exemplary embodiments, and, as it is apparent in the appended claims, diverse variations and modifications may be realized in the present invention by anyone skilled in the field to which the present invention belongs. And, it should also be understood that all identical or equivalent modifications belong to the scope of the spirit of the present invention.

The invention claimed is:

1. A laundry treating apparatus, comprising:

a cabinet configuring an external feature and being provided with a laundry introduction port;

a door being aligned to open and close the introduction port;

a hinge unit configuring a first rotating axis rotating the door in a first rotating direction, and a second rotating axis rotating the door in a second rotating direction, the second rotating direction corresponding to a direction different from the first rotating direction, the hinge unit including a first shaft and a second shaft configuring the first rotating axis and a third shaft and a fourth shaft configuring the second rotating axis; and a rotating shaft shifting unit configured to be capable of being moved so as to rotatably fasten the door to any one of the first rotating axis and the second rotating axis, the rotating shaft shifting unit including a first shifting unit being extended along a width direction of the door and a second shifting unit being extended along a height direction of the door from one end of the first shifting unit and selectively and rotatably fastening the fourth shaft to the cabinet, wherein the fourth shaft is provided with a protrusion protruding toward the second shifting unit, and wherein an end portion of the protrusion comes in contact with the second shifting unit, and wherein a fourth side flat surface is formed on the protrusion provided on the fourth shaft, and the fourth side flat surface of the protrusion supports the second shifting unit by establishing surface contact with the second shifting unit.

2. The laundry treating apparatus of claim 1, wherein the fourth shaft is formed to be extended from one side of a fourth shaft bracket, the fourth shaft bracket being installed on the door, wherein the fourth shaft bracket is formed to envelop at least a portion of the second shifting unit, wherein the cabinet includes a guidance groove configured to accommodate a free end part of the second shifting unit, and wherein, when the door is rotated in the second rotating direction at a predetermined angle, at least a portion of the fourth shaft bracket is inserted in the guidance groove along with the free end part of the second shifting unit.

3. The laundry treating apparatus of claim 1, wherein the fourth shaft is provided with a first side flat surface formed along a length direction of the fourth shaft and a second side flat surface formed to face into the first side flat surface.

4. The laundry treating apparatus of claim 3, wherein the first side flat surface and the second side flat surface are formed to be parallel to one another.

5. The laundry treating apparatus of claim 3, wherein the cabinet is provided with a fourth shaft detachable part configured to accommodate the fourth shaft, wherein an receiving groove is formed in the fourth shaft detachable part, the receiving groove being configured to accommodate the fourth shaft, and wherein a width of an opening of the receiving groove is larger than a width between the first side flat surface and the second side flat surface.

6. The laundry treating apparatus of claim 5, wherein a stopper is formed on the fourth shaft detachable part, the stopper being configured to limit a rotating angle of the fourth shaft, wherein a third side flat surface corresponding to the first side flat surface of the fourth shaft is formed on the stopper, and wherein the first side flat surface establishes surface contact with the third side flat surface.

7. The laundry treating apparatus of claim 2, wherein the second shifting unit is provided with a first side surface facing into the fourth shaft and a second side surface facing into the first side surface, wherein the fourth shaft bracket is provided with an extended part configured to be extended along the second side surface of the second shifting unit, and wherein, when the door is rotated in the second rotating direction at a predetermined angle, the extended part of the fourth shaft bracket is inserted in the guidance groove along with the free end part of the second shifting unit.

8. The laundry treating apparatus of claim 7, wherein, when the door is rotated in the second rotating direction at a predetermined angle, the second shifting unit is being supported on an edge of the guidance groove by the extended part of the fourth shaft bracket.

9. The laundry treating apparatus of claim 2, wherein the fourth shaft is connected to a hinge arm, the hinge arm being extended from the fourth shaft bracket.

10. The laundry treating apparatus of claim 9, wherein the fourth shaft bracket is provided with a bracket body and the hinge arm, wherein the hinge arm is formed to be extended with an inclination from the bracket body and toward the fourth shaft detachable part, and wherein the bracket body, the hinge arm, and the fourth shaft are formed as a single body.

11. The laundry treating apparatus of claim 10, wherein the hinge arm is configured of two arms each being spaced apart from one another at a predetermined distance, and wherein the fourth shaft is provided between the two arms.

12. The laundry treating apparatus of claim 1, further comprising:

a lock configured to limit movements of the rotating shaft shifting unit.

13. The laundry treating apparatus of claim 12, wherein the rotating shaft shifting unit is provided with a first shifting unit being extended along a horizontal direction, and a second shifting unit being extended along a vertical direction from one end of the first shifting unit and selectively and rotatably fastening the fourth shaft to the cabinet, and wherein the lock is configured to fix a position of at least any one of the first shifting unit and the second shifting unit.

14. The laundry treating apparatus of claim 13, further comprising:

a first coupling part and a second coupling part each being provided to be spaced apart from one another at a predetermined distance along a moving direction of the first shifting unit, or each being provided to be spaced apart from one another at a predetermined distance along a moving direction of the second shifting unit, and being detachably coupled to the lock, and wherein, when the door opens the introduction port, the lock is coupled to any one of the first coupling part and the second coupling part, thereby fixing a position of at least any one of the first shifting unit and the second shifting unit.

* * * * *